US011835908B2

(12) United States Patent
Kawasumi

(10) Patent No.: US 11,835,908 B2
(45) Date of Patent: Dec. 5, 2023

(54) IMAGE FORMING APPARATUS HAVING A FRAME BODY WITH A FIRST FRAME AND A SECOND FRAME

(71) Applicant: CANON KABUSHIKI KAISHA, Tokyo (JP)

(72) Inventor: Ryoichi Kawasumi, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/734,771

(22) Filed: May 2, 2022

(65) Prior Publication Data

US 2022/0365474 A1 Nov. 17, 2022

(30) Foreign Application Priority Data

May 13, 2021 (JP) ..... 2021-081509

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/90
See application file for complete search history.

(56) References Cited

U.S. PATENT DOCUMENTS 5,918,089 A * 6/1999 Malinich ..... G03G 15/80 399/110
10,148,833 B2 12/2018 Nakayama
10,530,944 B2 1/2020 Nakayama
10,701,224 B2 6/2020 Nakayama
11,082,571 B2 8/2021 Nakayama
11,405,526 B2 8/2022 Nakayama
2017/0336749 A1* 11/2017 Ando ..... H01R 13/629
2018/0103542 A1* 4/2018 Shinotsuka ..... G03G 21/1652
2020/0310327 A1* 10/2020 Kanno ..... G03G 21/1619
2022/0091555 A1 3/2022 Kawasumi

FOREIGN PATENT DOCUMENTS

JP 2015-99387 A 5/2015

OTHER PUBLICATIONS

U.S. Appl. No. 17/850,136, filed Jun. 27, 2022 by Yoshiyuki Nakayama.

* cited by examiner

*Primary Examiner* — Quana Grainger
(74) *Attorney, Agent, or Firm* — VENABLE LLP

(57) ABSTRACT

An image forming apparatus includes a first electrical component, a second electrical component, a control board, a frame body, and a connection unit. The first electrical component includes a first connector configured to be connected to the control board. The second electrical component includes a second connector configured to be connected to the control board. The connection unit includes a first and a second cables connected to the control board, a first relay connector, and a second relay connector. The first relay connector is provided on a leading end portion of the first cable to be arranged on the first frame such that the first connector is connected to the first relay connector. The second relay connector is provided on a leading end portion of the second connector to be arranged on the first frame such that the second connector is connected to the second relay connector.

13 Claims, 15 Drawing Sheets

IMAGE FORMING APPARATUS HAVING A FRAME BODY WITH A FIRST FRAME AND A SECOND FRAME

BACKGROUND OF THE INVENTION

Field of the Invention

The present invention relates to image forming apparatuses equipped with a plurality of electrical components, such as copying machines, printers, facsimiles, or multifunction machines having a plurality of these functions.

Description of the Related Art

Hitherto, image forming apparatuses such as copying machines, printers, or facsimiles are equipped with a power supply, a high-pressure board, and a control board to control electrical components, such as various motors, various sensors, and switches provided therein. The power supply, the high-pressure board, and the control board are mainly arranged in a space at a rear side of an apparatus body, and similarly, the main motors are also often arranged in the space at the rear side of the apparatus. However, it is difficult to arrange all the electrical components including the various sensors, the switches and cooling fans collectively at the rear side of the apparatus, and such electrical components are generally often arranged in a vicinity of an area within the image forming apparatus in which they are needed, such as at a front side of the apparatus. Moreover, it is desirable that these electrical components are easily replaceable or assembled to cope with failure of the apparatus or for maintenance operations.

An image forming apparatus having an opening/closing detection sensor of a front cover or an air intake fan and the like arranged on a front side of an apparatus body is known (Japanese Patent Application Laid-Open Publication No. 2015-99387). A developer cartridge is generally equipped with a sensor for detecting a state of toner in the developer cartridge, and the developer cartridge is also disposed on a front side of the apparatus body as a unit equipped with electrical components. According to the disclosed image forming apparatus, replacement and assembly operations of the opening/closing detection sensor of the front cover, the air intake fan, and the developer cartridge are facilitated.

However, the fans, various motors, and various sensors are equipped with cables and bundle wires through which control signals are transmitted and that are connected to an electrical substrate arranged at a rear side of the apparatus. The same applies for fans and sensors arranged at a front side of the apparatus, and cables and bundle wires must be laid along an inner side of a frame body or a cover of the image forming apparatus from the front side to the electrical substrate arranged at the rear side of the apparatus. According to the configuration disclosed in the above-mentioned Japanese Patent Application Laid-Open Publication No. 2015-99387, the electrical components at the front side of the apparatus are arranged in a dispersed manner at various areas, such that the cables and bundle wires must be laid to thread through gaps formed between the respective components arranged on the front side, according to which the workability of assembly, replacement and maintenance is deteriorated.

The present invention provides an image forming apparatus having improved workability of assembly, replacement, and maintenance of electrical components that are not arranged on the rear side of the apparatus.

SUMMARY OF THE INVENTION

According to a first aspect of the present invention, an image forming apparatus includes a first electrical component, a second electrical component, a control board configured to control the first electrical component and the second electrical component, a frame body supporting the first electrical component, the second electrical component, and the control board, and a connection unit configured to connect the first electrical component and the second electrical component to the control board. The frame body includes a first frame and a second frame, the first frame being provided on a front side of the image forming apparatus and attached with the first electrical component and the second electrical component, the second frame being provided on a rear side of the image forming apparatus so as to be spaced from the first frame and attached with the control board. The first electrical component includes a first connector configured to be connected to the control board. The second electrical component includes a second connector configured to be connected to the control board. The connection unit includes a first cable connected to the control board, a second cable connected to the control board, a first relay connector, and a second relay connector, the first relay connector being provided on a leading end portion of the first cable to be arranged on the first frame such that the first connector is connected to the first relay connector, the second relay connector being provided on a leading end portion of the second connector to be arranged on the first frame such that the second connector is connected to the second relay connector.

Further features of the present invention will become apparent from the following description of exemplary embodiments with reference to the attached drawings.

DESCRIPTION OF THE EMBODIMENTS

First Embodiment

A first embodiment according to the present invention will be described in detail with reference to FIGS. 1 to 9. According to the present embodiment, a tandem-type full-color printer is illustrated as an example of an image forming apparatus 1. The present invention is not limited to the tandem-type image forming apparatus 1 and can be other types of image forming apparatuses, and it can be a monochrome or mono-color printer instead of the full-color printer. Further, it can be an inkjet-type printer. Moreover, in the following description, positional relationships, which are up, down, right, and left directions, a front side which is the side having an operation panel 30, and a rear side, are described based on a state in which the image forming apparatus 1 is viewed from a front side, i.e., the viewpoint of FIG. 1.

Image Forming Apparatus

Figure 1:
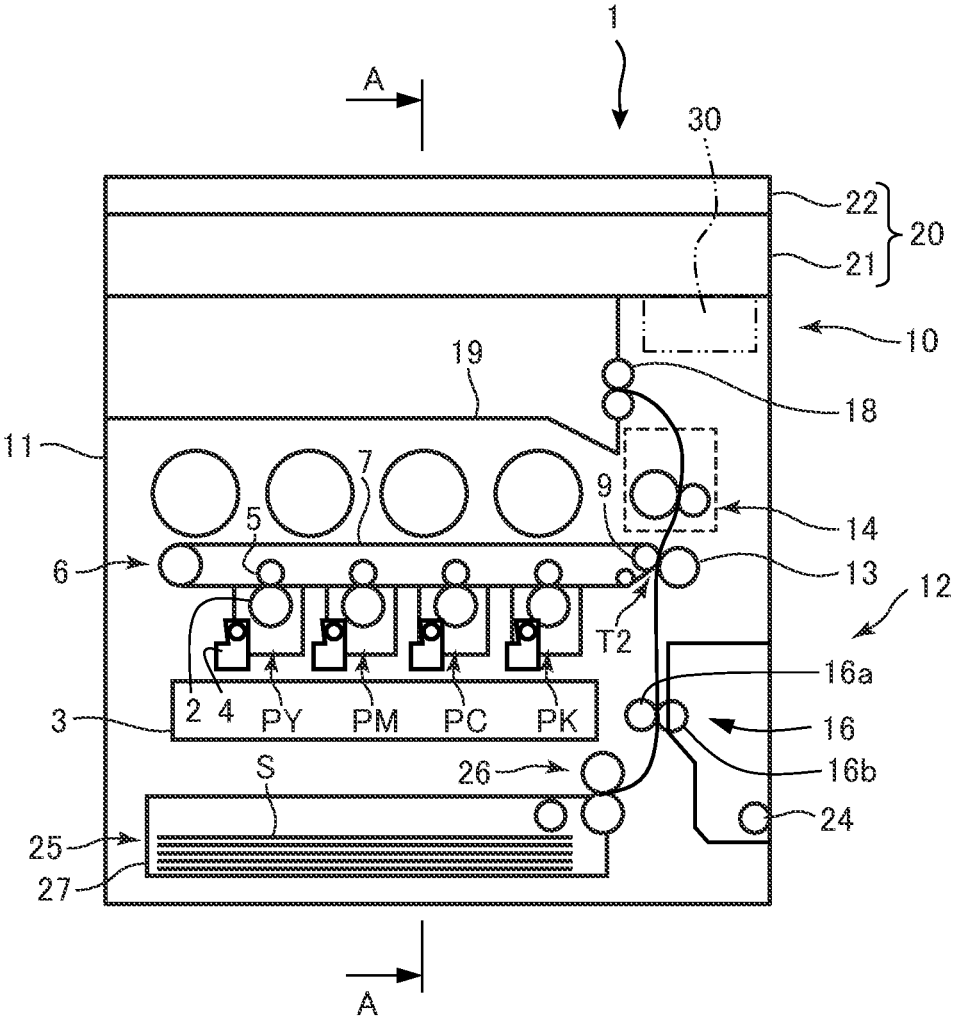
FIG. 1 is a cross-sectional view illustrating a general configuration of an image forming apparatus according to a first embodiment.

As illustrated in FIG. 1, the image forming apparatus 1 mainly includes an apparatus body 10, and an image reading unit 20 arranged above the apparatus body 10. The apparatus body 10 includes an image forming device 6, and an image is formed by the image forming device 6 on a recording material S fed from a sheet feed cassette 27. The recording material S to which image has been formed is discharged onto a sheet discharge tray 19. The recording material S can be paper such as normal paper, thick paper, rough paper, uneven paper, coated paper, glossy paper, and photographic paper, or various types of sheet materials such as plastic films and cloths.

An operation panel 30 that allows a user to operate the image forming apparatus 1 is arranged at an upper portion of the apparatus body 10. An image reading unit 20 for reading image information from documents includes a reading unit body 21 equipped with a platen glass, and a platen cover 22 that can be opened and closed with respect to the reading unit body 21. Image information of a document placed on the platen glass is extracted by scanning via a scanning optical system included in the reading unit body 21.

The image forming device 6 forms an image based on image information received from the image reading unit 20 or an external apparatus not shown, such as a portable terminal including smartphones or a personal computer. The image forming device 6 is stored in an interior of a frame body 11 of the apparatus body 10. In the present embodiment, the image forming device 6 adopts a so-called tandem-type intermediate transfer system that includes four image forming units PY, PM, PC, and PK. The image forming units PY, PM, PC, and PK respectively form a toner image of yellow (Y), magenta (M), cyan (C), and black (K), and an image is formed via an intermediate transfer belt 7 to the recording material S.

The image forming units PY, PM, PC, and PK adopt a similar configuration except for the difference in toner colors, so that in the present description, the image forming unit PY is described as a representative example with reference numerals assigned thereto. The image forming unit PY includes a charger not shown, such as a charging roller, a developing apparatus 4, and a cleaner not shown that are arranged in a circumference of a photosensitive drum 2 composed of a photosensitive member such as an organic photoconductor (OPC). In an image forming operation, at first, a latent image is formed on the photosensitive drums 2 of the respective image forming units PY, PM, PC, and PK. As a preparation operation, high voltage is applied to the charger in pressure contact with the photosensitive drum 2, and the surface of the photosensitive drum 2 is uniformly charged along with the rotation of the photosensitive drum 2. Next, high voltage is applied to a developing sleeve of the developing apparatus 4 through a path that differs from the charger, and charged toner in the developing apparatus 4 is coated evenly to a surface of the developing sleeve. Then, by performing laser scanning at an exposure unit 3, a latent image is formed by potential difference on the surface of the photosensitive drum 2, and toner on the developing sleeve develops the latent image on the photosensitive drum 2 as a toner image. The toner image developed on the photosensitive drum 2 is primarily transferred to the intermediate transfer belt 7 by having primary transfer voltage applied to a primary transfer roller 5 opposing the photosensitive drum 2 with the intermediate transfer belt 7 interposed therebetween.

The intermediate transfer belt 7 is driven to rotate along a conveyance direction of the recording material S, that is, upward in the drawing, at a secondary transfer portion T2. A full-color toner mage is formed on the surface of the intermediate transfer belt 7 by having the single-colored toner images formed in each of the image forming units PY, PM, PC, and PK transferred in multiple layers. The toner image formed on the surface of the intermediate transfer belt 7 is secondarily transferred to the recording material S at the secondary transfer portion T2 formed between a secondary transfer roller 13 and a counter roller 9. In that state, a secondary transfer voltage is applied to the secondary transfer roller 13.

At a matched timing with the image forming process described above, the recording material S is supplied to the image forming device 6. A sheet feed portion 25 provided at a lower portion of the apparatus body 10 includes the sheet feed cassette 27 storing the recording material S and a feed roller 26 that separates and conveys the recording materials S stored in the sheet feed cassette 27 one by one.

A conveyance path for conveying the recording material S upward along a right side of the apparatus body 10 from below is arranged at a right side in the interior of the apparatus body 10. The feed roller 26, a conveyance roller pair 16, the secondary transfer roller 13, a fixing unit 14, and a sheet discharge roller pair 18 are arranged in the named order from a lower side along the conveyance path. The recording material S sent out by the feed roller 26 is subjected to skew correction by the conveyance roller pair 16 and conveyed toward the secondary transfer portion T2 in synchronization with the transfer timing of the toner image. The recording material S having an unfixed toner image formed thereto at the secondary transfer portion T2 is conveyed to the fixing unit 14 having a roller pair and a heating source and subjected to heat and pressure. Thereby, toner is melted and solidified, and the toner image is fixed to the recording material S. The recording material S to which toner image has been fixed is discharged by the sheet discharge roller pair 18 to the sheet discharge tray 19 provided at an upper portion of the image forming device 6.

Figure 2A:
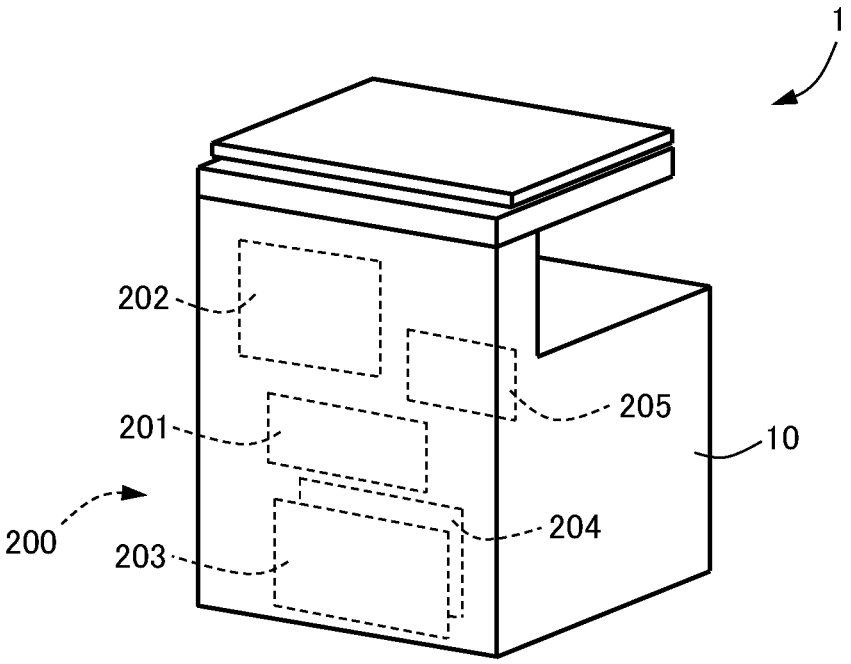
FIG. 2A is a perspective view of the image forming apparatus according to the first embodiment viewed from a rear side, illustrating a substrate portion.
Figure 2B:
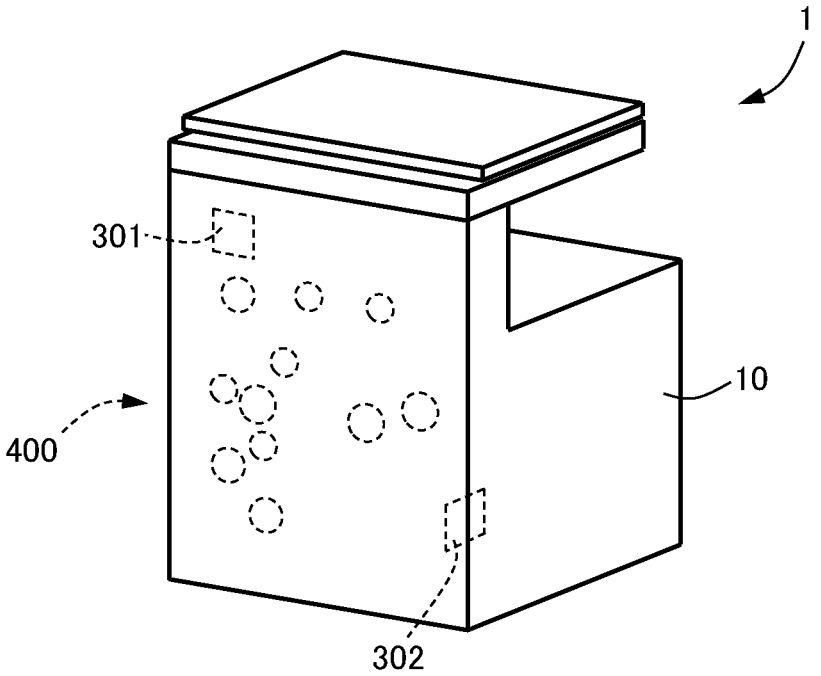
FIG. 2B is a perspective view of the image forming apparatus according to the first embodiment viewed from the rear side, illustrating fans and motors.

Next, an arrangement of electrical components in the image forming apparatus 1 will be described with reference to FIGS. 2A to 4. In the specification, the electrical components refer to a substrate portion 200 for carrying out various controls in the operation of the image forming apparatus 1 mentioned above, a motor portion 400 that is necessary for carrying out various driving operations, a switch portion, and a sensor portion. FIGS. 2A and 2B are perspective views of the apparatus body 10, illustrating a general arrangement of electrical components on a rear side of the image forming apparatus 1 viewed from a rear side. In FIG. 2A, the substrate portion 200 that performs control of the image forming operation is schematically illustrated. In FIG. 2B, fans 301 and 302 and the motor portion 400 are schematically illustrated. The motor portion 400 is arranged in a space in which the substrate portion 200 is not arranged, and a layout is adopted in which the motor portion 400 is accommodated together with the substrate portion 200 at the rear side of the apparatus body 10. For example, it seems that the motor portion 400 is positioned at the same position as the substrate portion 200 in FIGS. 2A and 2B, but actually, the motor portion 400 is arranged on the inner side of the substrate portion 200 such that they are arranged in layers so as not to overlap in a depth direction of the apparatus body 10.

The substrate portion 200 includes a main control board 201 that mainly carries out the control operation, a sub-control board 202 that supports the control operation, a board 203 for supplying power, and boards 204 and 205 for performing high-pressure output to the image forming portion. The main control board 201 is one example of a control board for controlling the plurality of electrical components, and it is positioned near a center of the apparatus body 10, that is, arranged at an approximately center portion in a vertical direction. The respective boards are mutually connected via cables and bundle wires not shown for transmitting power and control signals. The same applies for the fans 301 and 302 and the motor portion 400, and they are connected to the main control board 201 via cables and wires not shown for transmitting control signals for performing various driving operations described above in the image forming operation. In the present embodiment, two boards 204 and 205 are provided for high pressure output, and two controls boards which are the main control board 201 and the sub-control board 202 are provided for control, but the number can be one each, or even three or more.

As described, the substrate portion 200 and the motor portion 400 are arranged collectively in the rear side space of the image forming apparatus 1, and a layout of cables and bundle wires connecting the respective portions is selected such that the lengths thereof are minimum. If the lengths of the cables and bundle wires are long, the costs thereof increase, noise may mix into the control signals, the cables and bundle wires tend to get tangled, and coatings thereof tend to be damaged during assembly, such that the path is preferably determined so that the bundle wire length is as short as possible. The electrical components arranged at the rear side of the apparatus body 10 are not limited to the substrate portion 200 and the motor portion 400, and various sensors and switches can also be arranged, but they are not shown in the drawing to avoid complication of the drawing.

Workability of assembly, replacement, and maintenance of the electrical components is also important. That is because the electrical components may need to be replaced due to various conditions, such as advancement of aging deterioration by long-term operation of the image forming apparatus 1 or reaching of service life of the electrical components. Further, the workability of assembly, replacement, and maintenance of the electrical components must also be considered to facilitate maintenance or to enable components to be replaced in a short time. As described above, the paths for laying the bundle wires of the electrical components should be selected to realize balance between assembling workability and bundle wire length.

As for the electrical components arranged on the rear side of the apparatus body 10, the substrate portion 200 and the motor portion 400 arranged in layers as mentioned above are made visible by removing a rear side cover not shown in FIG. 2. Therefore, a major portion of the electrical components can be detached by removing the units and components on the surface layer, such that the required assembling and replacement workability is sufficiently ensured. As for the bundle wire length, the length will not be longer than necessary since the components are arranged collectively on the rear side.

Figure 3:
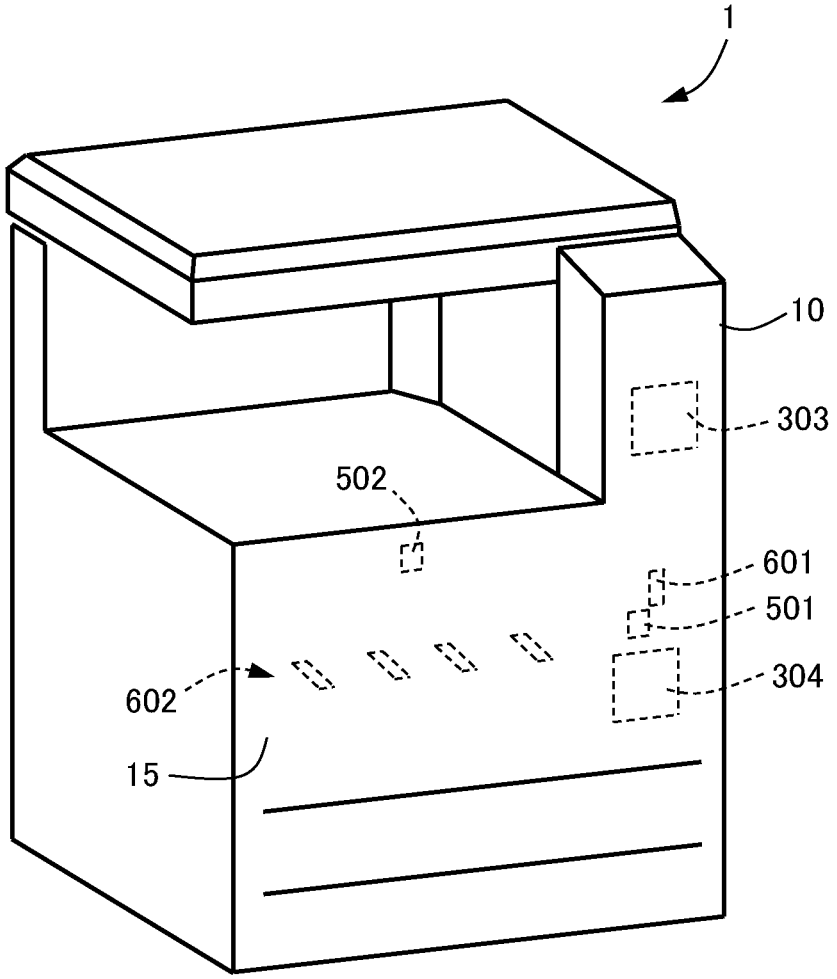
FIG. 3 is a perspective view of the image forming apparatus according to the first embodiment viewed from a front side.

Meanwhile, there are some electrical components that are not arranged at the rear side of the apparatus body 10. FIG. 3 is a perspective view showing a general arrangement of electrical components on a front side of the apparatus body 10 viewed from a front side of the image forming apparatus 1. In FIG. 3, fans 303 and 304 for supplying air to an interior of the apparatus body 10, switches 501 and 502, and sensors 601 and 602 are schematically illustrated.

These are electrical components that are not easily arranged on the rear side of the apparatus body 10. A switch 501 is an interlock switch serving as an example of a first electrical component that performs switching of signals according to an opening and closing state of a front cover 15, and a switch 502 is an open/close detection switch for detecting the opening and closing state of the front cover 15. The front cover 15 is an example of a cover that can open and close a front side, that is, first frame side, of the apparatus body 10. If the state of the front cover 15 is to be detected from a rear side of the apparatus body 10 without providing an electrical switch on the front side of the apparatus body 10, a large-scale link mechanism is required, such that the switches 501 and 502 must be arranged on the front side of the apparatus body 10.

The fans 303 and 304 are arranged on the front side of the apparatus body 10 to cool the front side of the apparatus body 10, and therefore, the cooling efficiency is higher compared to the case where the fans are arranged at other parts of the apparatus body 10. The fan 303 is an example of a second electrical component that cools an upper portion of the front side of the apparatus body 10, and the fan 304 cools a lower portion of the front side of the apparatus body 10. The sensors 602 are each provided on the four developing apparatuses 4 to detect the state of toner accommodated in the developing apparatuses 4, and it is difficult to arrange the sensors 602 on the rear side of the apparatus body 10.

Figure 4:
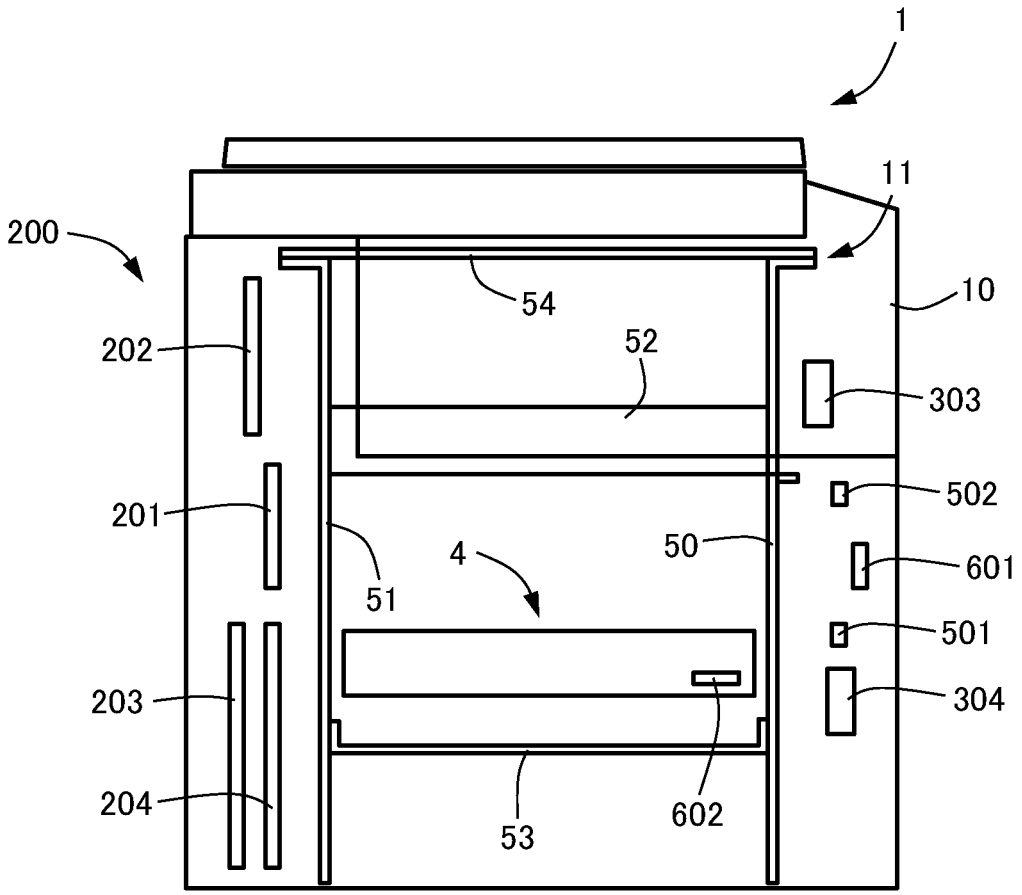
FIG. 4 is a cross-sectional view illustrating the image forming apparatus according to the first embodiment cut at line A-A of FIG. 1.

FIG. 4 is a cross-sectional view in which a state of the apparatus body 10 cut at line A-A of FIG. 1 is viewed from a left side of the apparatus body 10. As illustrated in FIG. 4, the frame body 11 serving as a casing of the apparatus body 10 includes a front side panel 50, a rear side panel 51, and stays 52, 53, and 54 that connect the front and rear side panels in a front-rear direction. The substrate portion 200 is arranged on a rear side of the rear side panel 51 serving as the rear side of the apparatus body 10, and the fans 303 and 304, the switches 501 and 502, and the sensors 601 and 602 are arranged at the front side of the front side panel 50. That is, the frame body 11 supports the plurality of electrical components and the substrate portion 200.

The electrical components arranged at the front side of the apparatus body 10 also require the connection of cables and bundle wires through which control signals are transmitted to the components. However, as illustrated in FIG. 3, the electrical components are distributed in a wide area on the front side of the apparatus body 10. Meanwhile, as illustrated in FIG. 4, at least a distance equal to or greater than the distance between the front side panel 50 and the rear side panel 51 exists between the front side of the front side panel 50 on which the electrical components are arranged and the main control board 201 arranged on the rear side of the rear side panel 51 spaced apart therefrom. Therefore, in order to appropriately set the bundle wire path from the electrical components arranged on the front side of the apparatus body 10 to the main control board 201, it is necessary to adopt an arrangement in which the path becomes as short as possible while avoiding interference with non-electrical components such as an inner cover provided on the front side of the apparatus body 10. Similar to the electrical components arranged at the rear side of the apparatus body 10, the components at the front side of the apparatus body 10 must also be arranged considering the assembly and replacement workability, so that the bundle wire path must be arranged appropriately also from this viewpoint. Therefore, according to the present embodiment, the bundle wire path is arranged appropriately using a bundle wire unit 60 as described below.

Bundle Wire Unit

Figure 5A:
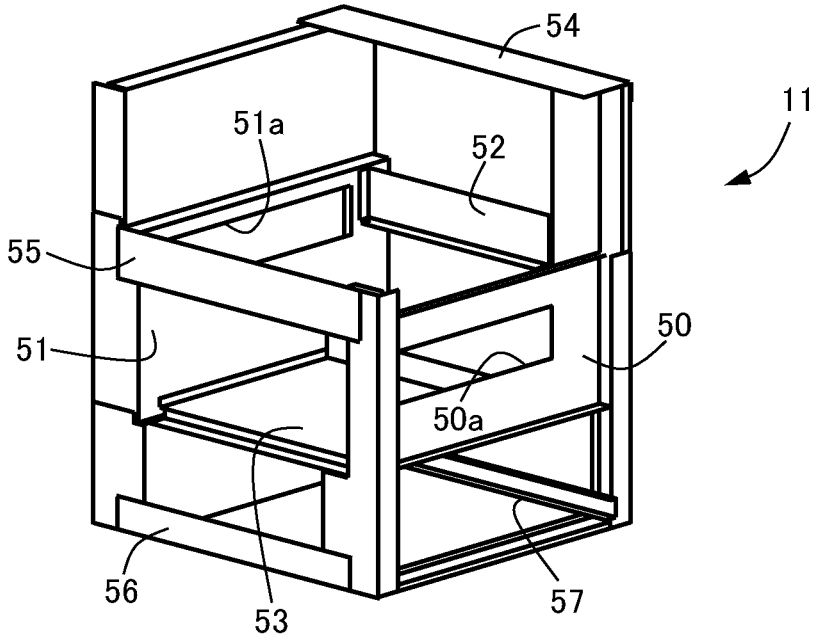
FIG. 5A is a perspective view illustrating a frame body of the image forming apparatus according to the first embodiment from the front side.
Figure 5B:
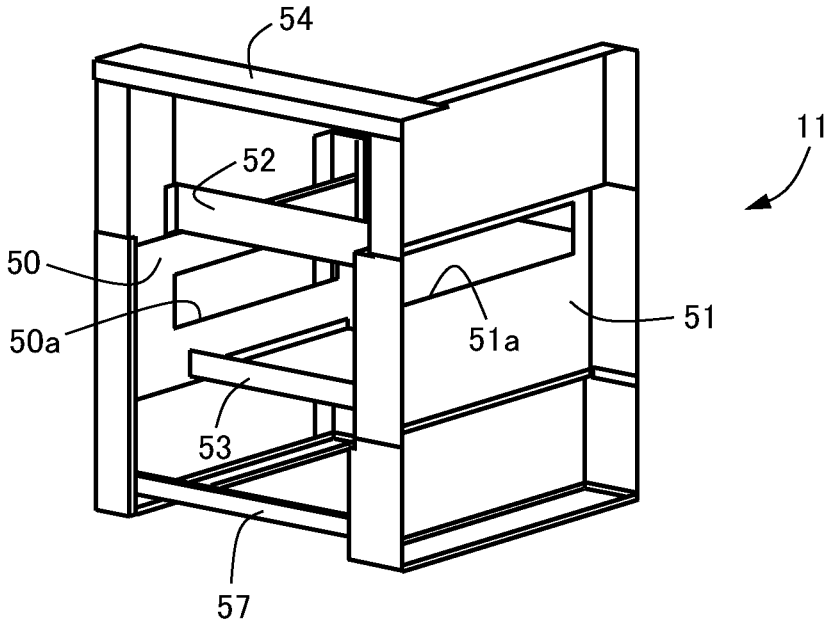
FIG. 5B is a perspective view illustrating the frame body of the image forming apparatus according to the first embodiment from the rear side.
Figure 6:
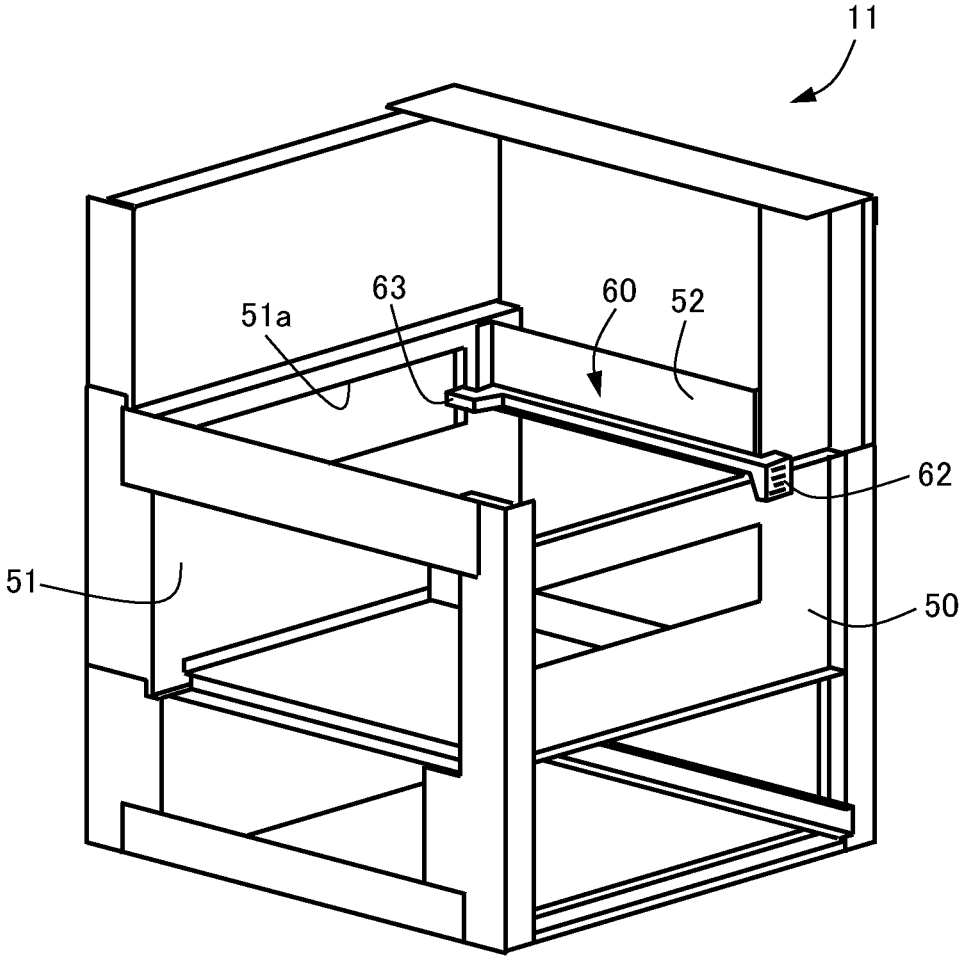
FIG. 6 is a perspective view illustrating the frame body of the image forming apparatus according to the first embodiment from the front side.

Now, the bundle wire path from the electrical components on the front side of the image forming apparatus 1 to the main control board 201 and configuration thereof will be described with reference to FIGS. 5A to 8. FIGS. 5A, 5B and 6 illustrate the frame body 11 of the image forming apparatus 1. FIG. 5A is a perspective view from a front side of the apparatus body 10, and FIG. 5B is a perspective view from a rear side of the apparatus body 10.

As illustrated in FIGS. 5A and 5B, the frame body 11 includes the front side panel 50 arranged on the front side of the apparatus body 10, the rear side panel 51 arranged on the rear side thereof, and stays 52 to 57 that connect the front and rear side panels in the front-rear direction, by which a casing structure is constituted. The front side panel 50 is an example of a first frame arranged on the front side of the apparatus body 10 and to which the plurality of electrical components are attached. The rear side panel 51 is an example of a second frame arranged on the rear side of the apparatus body 10 and to which the substrate portion 200 is attached, the rear side panel 51 arranged at a position spaced apart from the front side panel 50. In the present embodiment, an area toward the front from a center portion in the front-rear direction of the image forming apparatus 1 is referred to as the front side, and an area toward a rear side from the center portion is referred to as the rear side. An opening 50*a* through which the image forming units PY, PM, PC, and PK including the developing apparatuses 4 (refer to FIG. 1) is inserted and removed is formed at a center portion of the front side panel 50, and an opening 51*a* is formed on the rear side panel 51.

Regarding the bundle wire path from the electrical components disposed on the front side of the apparatus body 10, the path toward the rear side of the apparatus body 10 must be laid along one of the stays 52 to 57. If the aim of the arrangement is to merely adopt the shortest path, the stay closest to each electrical component should be selected, such as the stay 52 as the path for laying the bundle wire of the fan 303 and the stay 53 as the path for the sensors 602. However, as mentioned above, the workability of assembly, replacement and maintenance of the electrical components must also be considered.

Figure 7:
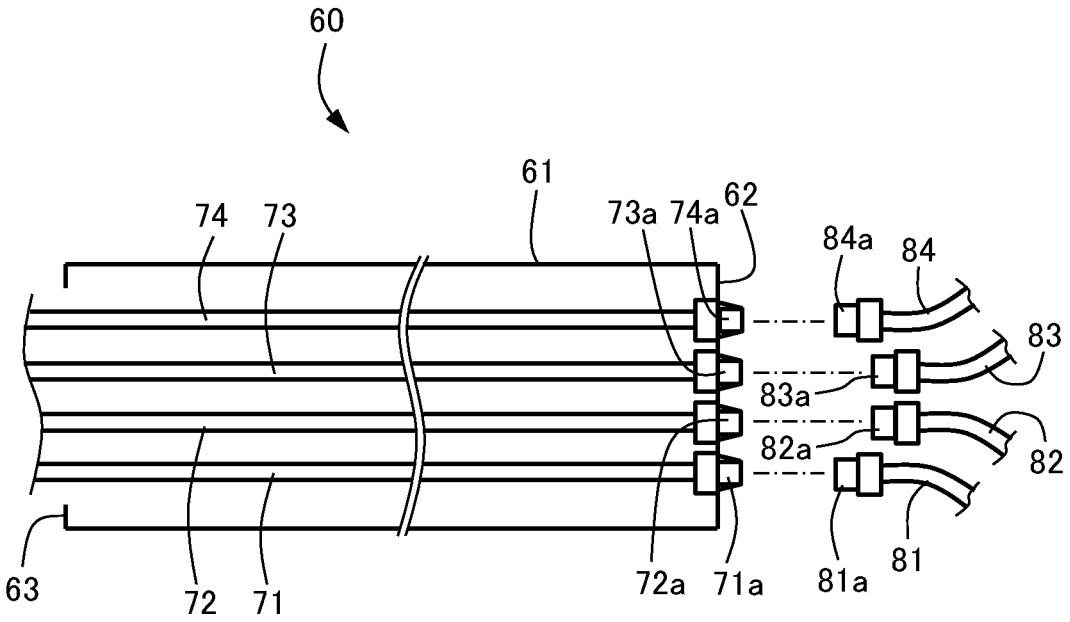
FIG. 7 is a plan view illustrating a bundle wire unit according to the first embodiment.

Therefore, according to the present embodiment, as illustrated in FIG. 6, the bundle wire unit 60 serving as a connection unit is attached along a side wall of the stay 52. As illustrated in FIG. 7, the bundle wire unit 60 includes a case body 61 whose longitudinal direction corresponds to the front-rear direction of the image forming apparatus 1, a plurality of cables 71 to 74 accommodated in the case body 61, and relay connectors 71*a* to 74*a* attached to the leading ends of the cables 71 to 74. The case body 61 accommodates the first cable 71, the second cable 72, the third cable 73, and the fourth cable 74, and the case body 61 is attached to the stay 52. The first relay connector 71*a* arranged on the front side panel 50 is provided at a leading end portion of the first cable 71, and the second relay connector 72*a* arranged on the front side panel 50 is provided at a leading end portion of the second cable 72. The third relay connector 73*a* arranged on the front side panel 50 is provided at a leading end portion of the third cable 73, and the fourth relay connector 74*a* arranged on the front side panel 50 is provide at a leading end portion of the fourth cable 74. In the present embodiment, the relay connectors 71*a* to 74*a* are connectors of different shapes and sizes. However, the present technique is not limited to this example, and at least a part of the connectors among the relay connectors 71*a* to 74*a* can have the same shapes and sizes. Further, the number of cables 71 to 74 is not limited to four, and the number can be at least two.

The respective cables 71 to 74 are connected to the main control board 201. A leading end portion 62 of the bundle wire unit 60 on the front side of the apparatus body 10 and a trailing end portion 63 on the rear side thereof are each extended beyond the front side panel 50 and the rear side panel 51, and the relay connector 71*a* to 74*a* of the respective cables 71 to 74 are arranged on an end face of the leading end portion 62.

Meanwhile, the switch 501, the fan 304 and the sensor 601 (refer to FIG. 8A) include a cable 81 for connection to the main control board 201, and a first connector 81*a* attached to a leading end of the cable 81. The first connector 81*a* is connected to the first relay connector 71*a* of the bundle wire unit 60, and the switch 501, the fan 304, and the sensor 601 are connected via the first cable 71 to the main control board 201. The fan 303 (refer to FIG. 8A) includes a cable 82 for connection to the main control board 201, and a second connector 82*a* attached to a leading end of the cable 82. The second connector 82*a* is connected to the second relay connector 72*a* of the bundle wire unit 60, and the fan 303 is connected via the second cable 72 to the main control board 201. The sensors 602 (refer to FIG. 8A) include a cable 83 for connection to the main control board 201, and a third connector 83*a* attached to a leading end of the cable 83. The third connector 83*a* is connected to the third relay connector 73*a* of the bundle wire unit 60, and the sensors 602 are connected to the main control board 201 via the third cable 73. The switch 502 (refer to FIG. 8A) includes a cable 84 for connection to the main control board 201, and a fourth connector 84*a* attached to the leading end of the cable 84. The fourth connector 84*a* is connected to the fourth relay connector 74*a* of the bundle wire unit 60, and the switch 502 is connected to the main control board 201 via the fourth cable 74. As described, the bundle wire unit 60 is an example of a control unit and serves to connect the plurality of electrical components and the main control board 201.

As illustrated in FIG. 4, the stay 52 is the stay closest to the main control board 201 arranged near the center of the apparatus body 10. Therefore, the leading end portion 62 of the bundle wire unit 60 is a guide that realizes a shortest bundle wire path from the front side traversing the front side panel 50 and the rear side panel 51 to the main control board 201. The stay 52 is an example of a third frame that connects the front side panel 50 and the rear side panel 51. The main control board 201 is arranged in a vicinity of a connecting portion between the stay 52 and the rear side panel 51. That is, the main control board 201 is arranged on the rear side panel 51 such that at least a part of the main control board 201 is overlapped with the stay 52 when viewed in the front-rear direction along the stay 52.

Figure 8A:
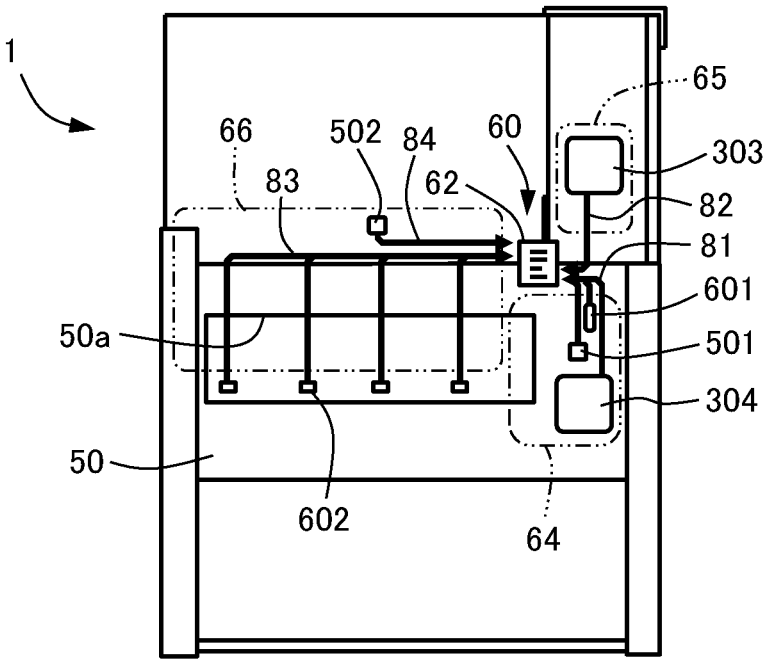
FIG. 8A illustrates a wiring related to the bundle wire unit of the image forming apparatus according to the first embodiment viewed from the front.
Figure 8B:
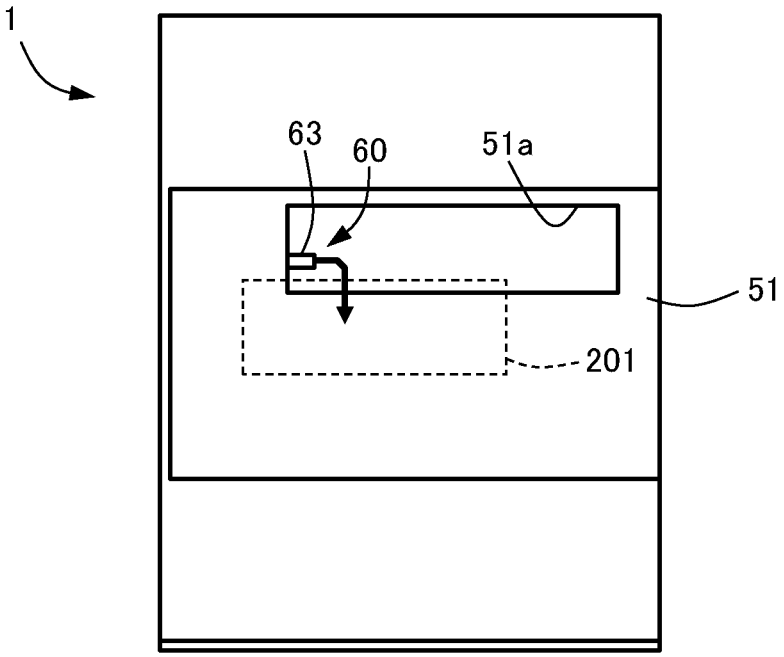
FIG. 8B illustrates a wiring related to the bundle wire unit of the image forming apparatus according to the first embodiment viewed from the rear.

FIGS. 8A and 8B schematically illustrate the bundle wire path on the front side of the apparatus body 10 determined by considering balance between workability of assembly and replacement and the bundle wire length using the bundle wire unit 60 illustrated in FIG. 7. FIG. 8A illustrates a bundle wire path arrangement viewed from the front side of the apparatus body 10, and FIG. 8B illustrates a bundle wire path arrangement viewed from the rear side of the apparatus body 10. In FIG. 8A, the fans 303 and 304, the switches 501 and 502, and the sensors 601 and 602 are illustrated, and the bundle wire path is illustrated in a simplified manner by bold line arrows. The bundle wire path is designed such that all the bundle wires of the electrical components arranged on the front side of the apparatus are concentrated to the leading end portion 62, and the bundle wires are connected via the relay connectors 71*a* to 74*a* (refer to FIG. 7) arranged at the end portion. Though limited to the path leading to the leading end portion 62, it can be recognized that the bundle wire length is shortest based on the simplified illustration of the bundle wire.

Further, a two-dot dashed line illustrated in FIG. 8A shows boundaries of units including the electrical components arranged in the interior of the apparatus and the bundle wires thereof. That is, a unit 64 is a unit including the fan 304, the switch 501, the sensor 601, and the bundle wires thereof, and a unit 65 is a unit including the fan 303 and the bundle wire thereof. The respective units 64 to 66 are arranged such that they are not overlapped with each other when viewed from the front side, as illustrated in FIG. 8A, and therefore, the units can be independently attached and detached from the front side by removing the front cover 15 (refer to FIG. 3) and an inner cover 67 (refer to FIG. 9). That is, in a state where the front cover 15 and the inner cover 67 are opened, the relay connectors 71*a* to 74*a* and the connectors 81*a* to 84*a* are exposed.

Further, by forming components into units, the units to be fixed and the fixing positions thereof to the apparatus body 10 have increased freedom, such that by selecting the most suitable fixing method for each of the units, a configuration that optimizes the workability of assembly, replacement, and maintenance of the units, and the electrical components included in the units, is realized. That is, the bundle wire path is converged to the bundle wire unit 60 illustrated in FIGS. 6 to 8B, the electrical components are formed as units 64 to 66 that are integrated with the respective bundle wires, and they are connected via the relay connectors 71*a* to 74*a* of the leading end portion 62. Thereby, it is recognized that an optimum configuration realizing a good balance among workability of assembly and maintenance and the bundle wire length at the front side of the apparatus body 10 is realized.

On the rear side of the apparatus body 10 illustrated in FIG. 8B, the trailing end portion 63 of the bundle wire unit 60 at the rear side of the apparatus body 10 extends to the vicinity of the main control board 201 illustrated by the broken line through the opening 51*a* on the rear side panel 51. Based on FIG. 8B, it can be recognized that the length of the bundle wire path laid from the front side to the rear side of the apparatus body 10 is minimized by passing through the bundle wire unit 60.

Figure 9:
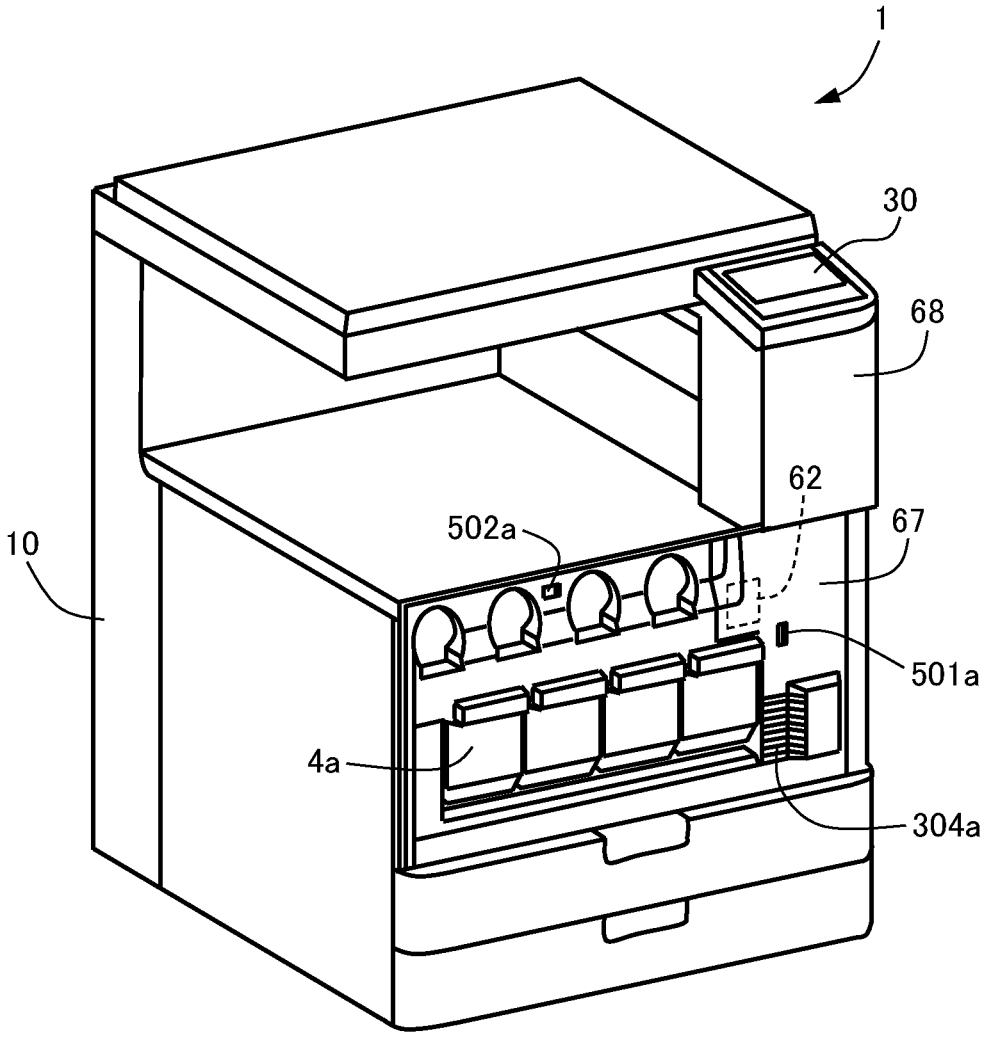
FIG. 9 is a perspective view from the front side illustrating a state in which a front cover is omitted in the image forming apparatus according to the first embodiment.

Next, the attachment and detachment of the units 64 to 66 will be described with reference to FIG. 9. FIG. 9 is a perspective view illustrating the apparatus body 10 from a front direction with the front cover 15 removed such that the area surrounding the inner cover 67 is visible. In FIG. 9, openings 501*a* and 502*a* are illustrated as access ports to the switches 501 and 502. Further, a louver 304*a* that forms an air passage for the fan 304, and four doors 4*a* through which insertion and removal of the image forming units PY, PM, PC, and PK including the developing apparatuses 4 are performed are illustrated. Further, the leading end portion 62 is illustrated by a dashed line, which is hidden behind the inner cover 67. Further, an exterior cover 68 is arranged directly above the inner cover 67.

In the attaching and detaching operation of the units 64 to 66 mentioned above, at first, the inner cover 67 is removed to expose the unit 64 and the leading end portion 62, such that the attachment and detachment of the unit 64 can be performed easily. Further, by removing the exterior cover 68, the unit 65 is exposed, and attachment and detachment thereof can be performed easily. Further, since the unit 66 and the inner cover 67 are formed integrally, attachment and detachment thereof is made possible by removing the inner cover 67 and exposing the leading end portion 62.

As described above, according to the image forming apparatus 1 of the present embodiment, the electrical components on the front side and the main control board 201 on the rear side are connected by the bundle wire unit 60. Thereby, the electrical components that are not arranged on the rear side of the image forming apparatus 1 can also have advantageous workability of assembly, replacement, and maintenance, and an arrangement of electrical components that does not require long cables and bundle wires to be connected to the main control board 201 can be acquired.

According further to the image forming apparatus 1 of the present embodiment, the bundle wire unit 60 is assembled to the stay 52, such that the rigidity of the bundle wire unit 60 can be ensured.

According to the first embodiment described above, a case in which the bundle wire unit 60 is assembled to the stay 52 is described, but the present invention is not limited thereto, and the bundle wire unit 60 can be assembled to other stays. Further, the bundle wire unit 60 can be arranged to extend over the front side panel 50 and the rear side panel 51 without being assembled to the stay.

According further to the present embodiment, a case is illustrated in which the bundle wire unit 60 is arranged to extend over the front side panel 50 and the rear side panel 51, but the present disclosure is not limited thereto. That is, the bundle wire unit 60 should merely connect the control board and electrical components arranged opposite to the control board, and for example, in a case where the control board is arranged on a side portion, the bundle wire unit 60 can be arranged to extend over the left side panel and the right side panel.

Second Embodiment

Next, a second embodiment of the present invention will be described in detail with reference to FIGS. 10 to 15. The present embodiment differs from the first embodiment in that a relay connector 140 is arranged at a lower right part of the apparatus body 10. The other configurations are similar to the first embodiment, such that the same reference numerals are assigned, and detailed descriptions thereof are omitted.

Figure 10:
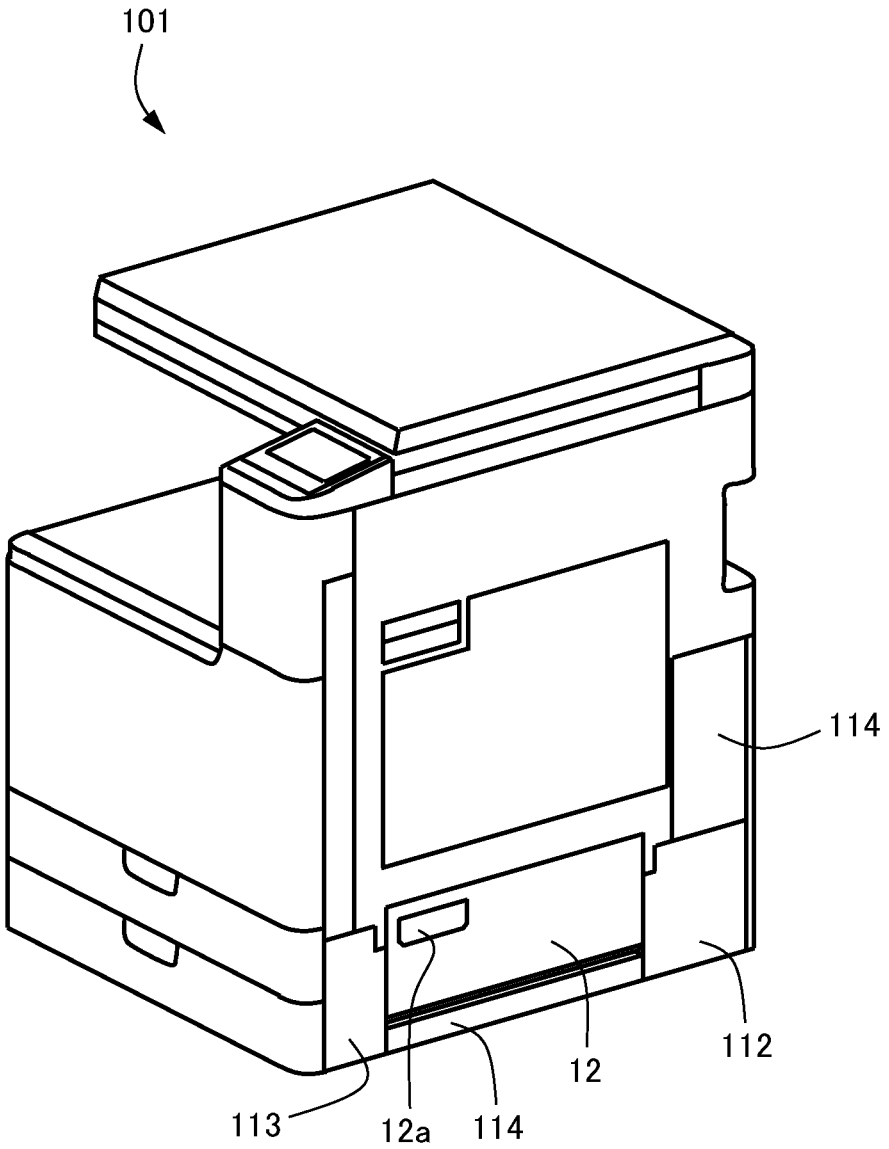
FIG. 10 is a perspective view from a front side illustrating a state in which a side cover is closed in an image forming apparatus according to a second embodiment.
Figure 11:
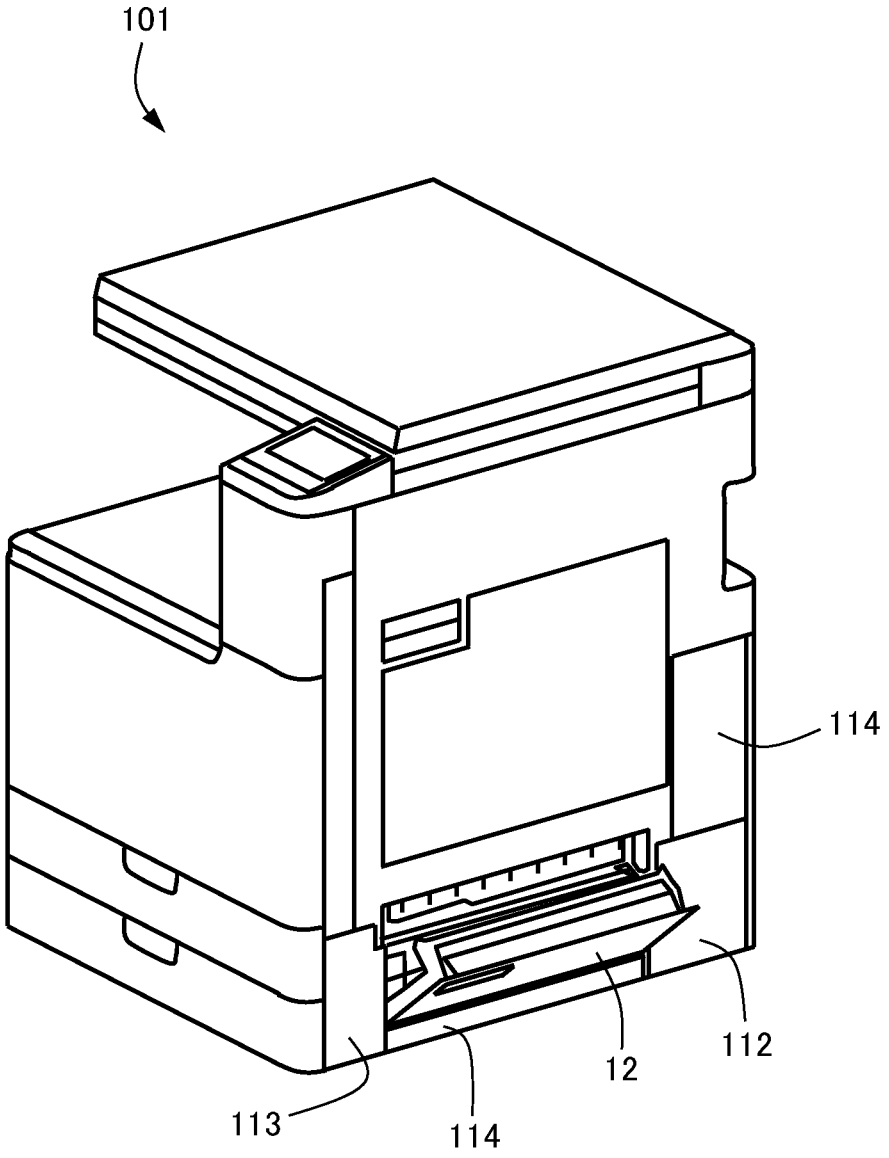
FIG. 11 is a perspective view from the front side illustrating a state in which the side cover is opened in the image forming apparatus according to the second embodiment.

A sheet feeding operation of the recording material S of the image forming apparatus 101 according to the present embodiment will be described in detail with reference to FIGS. 10 to 12C. FIGS. 10 and 11 are perspective views in which the image forming apparatus 1 is viewed from a front right side, and FIGS. 12A to 12C are enlarged cross-sectional views of a sheet feeding unit.

At first, in FIG. 1 described above, a conveyance roller 16*b* of the conveyance roller pair 16 that conveys the recording material S being fed to the image forming device 6 is arranged on the side of a pivoting door 12 which is designed to pivot about a pivot shaft 24. As illustrated in FIG. 10, a grip 12*a* is provided on the exterior surface side of the pivoting door 12, and by pulling the grip 12*a* forward, the pivoting door 12 can be pivoted to the state illustrated in FIG. 11.

Figure 12A:
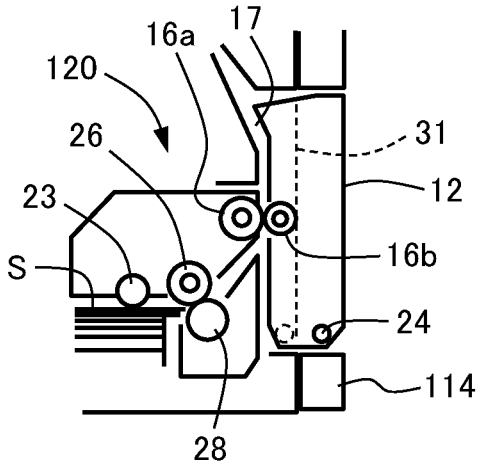
FIG. 12A is a cross-sectional view illustrating a state in which a pivoting door of a sheet feed unit according to the second embodiment is closed.
Figure 12B:
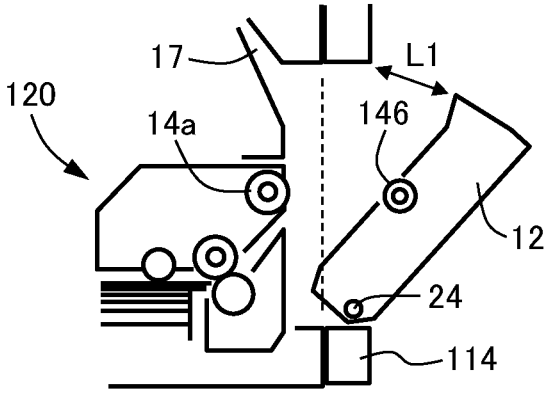
FIG. 12B is a cross-sectional view illustrating a state in which the pivoting door of the sheet feed unit according to the second embodiment is opened.
Figure 12C:
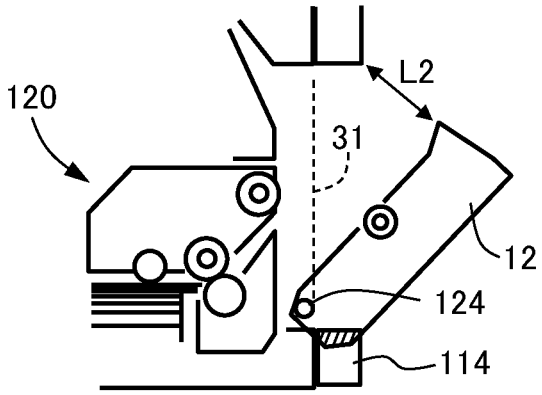
FIG. 12C is a cross-sectional view illustrating a state in which the pivoting door is supported by a frame body and opened in a sheet feed unit according to a reference example.

FIGS. 12A to 12C are enlarged cross-sectional views of the sheet feeding unit. FIG. 12A corresponds to the state of FIG. 10 in which the pivoting door 12 is closed, and FIG. 12B corresponds to the state of FIG. 11 in which the pivoting door 12 is opened. In FIG. 12A, a sheet feed unit 120 is illustrated, and a pickup roller 23, the feed roller 26, and a reverse rotation roller 28 are arranged. Further, a conveyance roller 16*a* serving as one of the rollers of the conveyance roller pair 16 is arranged downstream of the feed roller 26.

The sheet feeding operation is started by having a control signal from the main control board 201 not shown transmitted to the pickup roller 23, based on which the pickup roller 23 is driven to rotate. At first, the pickup roller 23 is lowered at a predetermined timing onto a sheet bundle supported in the sheet feed cassette 27 to feed a plurality of sheets to a nip formed by the feed roller 26 and the reverse rotation roller 28. The reverse rotation roller 28 is normally driven to rotate in a reverse direction (counterclockwise direction in FIG. 12), and when a predetermined torque is applied thereon, a clutch mechanism not shown on a rotation axis stops the reverse rotation drive, by which the reverse rotation roller 28 is driven to rotate following the rotation of the feed roller 26. Thereby, in a case where a plurality of recording materials S enter the nip, the torque on the shaft of the reverse rotation roller 28 is reduced by the slipping of sheets. Then, the reverse rotation roller 28 that has been driven to rotate along starts to rotate in the reverse direction, and the reverse rotation operation causes the sheet or sheets excluding the recording material S in contact with the feed roller 26 to be returned to the sheet feed cassette 27. The recording material S in contact with the feed roller 26 is fed as it is by the frictional force of the surface of the feed roller 26 and conveyed by the conveyance roller pair 16 to the image forming device 6 arranged downstream thereof.

As described, since the sheet feed unit 120 performs complex operations, various types of mechanical structures are installed. Complex mechanical structures tend to cause trouble, such that a configuration is required to enable maintenance to avoid occurrence of troubles or to facilitate repairing and trouble-shooting operations when trouble occurs. Further, paper dust that adheres to the sheet feed unit 120 during conveyance of the recording material S deteriorates the operation reliability of the sheet feed unit 120, and if accumulated in the conveyance path, may cause image defects. Furthermore, depending on the type of the recording material S being fed and conveyed, there may be a case where there are defects in the cutting or components contained in the sheets, by which the sheets tend to be jammed or delayed during conveyance. It is also recognized from this viewpoint that a configuration is necessary where maintenance and trouble-shooting operations including removal of paper dust and jammed recording materials S is facilitated.

The troubles that occur during the feeding and conveyance operations of the sheets can be largely classified into two types, a sheet conveyance operation failure that occurs in a conveyance path 17 and an operation failure of the sheet feed unit 120. The conveyance operation failure that occurs in the conveyance path 17 is, for example, sheet jam of the recording material S that occurs in the conveyance path 17, and the configuration of the pivoting door 12 described above is adopted to cope with the problem easily. If sheet jam occurs within the conveyance path 17, as illustrated in FIGS. 11 and 12B, the pivoting door 12 is pivoted and an access port denoted by reference L1 for accessing the conveyance path 17 is secured. At the same time, the nip of the conveyance roller pair 16 is spaced apart, such that the recording material S being jammed can be removed easily without getting caught.

Regarding the pivoting operation of the pivoting door 12, the pivot shaft 24 that protrudes from both ends of the pivoting door 12 are pivotably supported by a right front cover 113 and a right rear cover 112 illustrated in FIGS. 10 and 11. The position in which the pivot shaft 24 is pivotally supported is close to the exterior surface with respect to a right side surface 31 of the frame body of the apparatus illustrated by the dashed line in the cross-sectional vies of FIG. 12. According to this arrangement, the pivoting door 12 is supported by the cover and not by the frame body 11, but as an assumption, a case is considered in which the pivoting door 12 is supported by the frame body 11 with reference to FIG. 12C.

In FIG. 12C, a pivot shaft 124 is arranged on a left side of the right side surface 31 of the frame body 11 close to the inner side of the apparatus. If the pivoting door 12 is pivoted for the same angle about the pivot shaft 124, a width of an access port L2 for accessing the conveyance path 17 is not so different from that of the access port L1 when pivoted about the pivot shaft 24, but it can be recognized that the pivoting door 12 invades a lower right cover 114 below the pivoting door 12. Therefore, in order to avoid interference with the lower right cover 114, it is necessary to either reduce the rotation angle or to significantly vary the shape of the lower right cover 114, according to which either the width of the access port to the conveyance path 17 is narrowed or the appearance of the exterior cover is deteriorated, leading to deterioration of freedom of shape.

Therefore, the configuration of pivotally supporting the pivoting door 12 with the right front cover 113 and the right rear cover 112 is preferable over the configuration of supporting the pivoting door 12 by the frame member or at a position close to the frame member. The operation of coping with trouble that has occurred in the conveyance path 17 is as described above, and meanwhile, in a rare case where operation failure has occurred at the sheet feed unit 120, the sheet feed unit 120 must be removed from the apparatus body 10.

The configuration related to attaching and detaching the sheet feed unit 120 will be described in detail with reference to FIGS. 13A to 14. In order to attach/detach the sheet feed unit 120, at first, the pivoting door 12 must be removed. Since the pivoting door 12 is pivotally supported on the right rear cover 112 and the right front cover 113, the two covers must first be removed.

Figure 13A:
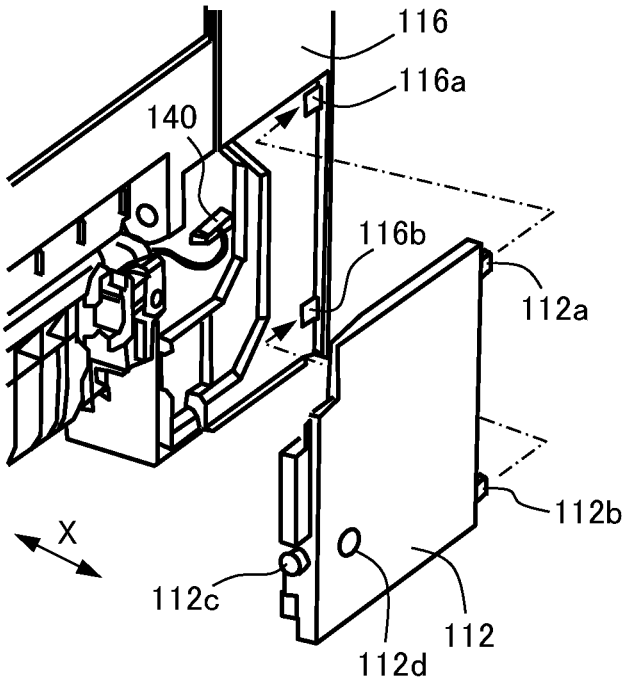
FIG. 13A is a perspective view of a right rear cover illustrating attachment and detachment of a cover of the sheet feed unit according to the second embodiment.

The fixing of the right rear cover 112 to the apparatus body 10 is performed by one screw not shown at a position corresponding to a fixing hole 112*d* illustrated in FIG. 13A. The fixing direction is a direction of arrow X perpendicular to the exterior surface of the cover. Since the size of the right rear cover 112 in the depth direction of the apparatus body 10 is great, an end portion at the depth side of the apparatus is engaged with an adjacent right depth-side cover 116 such that there are no lifting and detaching. Actually, projections 112*a* and 112*b* of the right rear cover 112 are inserted to positioning holes 116*a* and 116*b* provided on the right depth-side cover 116 via trajectories illustrated by dash-dot line arrows illustrated in FIG. 13A, such that there are no lifting and detaching of the depth end of the cover. By arranging a cylinder 112*c* for pivotally supporting the pivoting door 12 in a vicinity of the fixing hole 112*d*, the deviation or dispersion of the pivoting door 12 from the nominal position can be reduced.

Figure 13B:
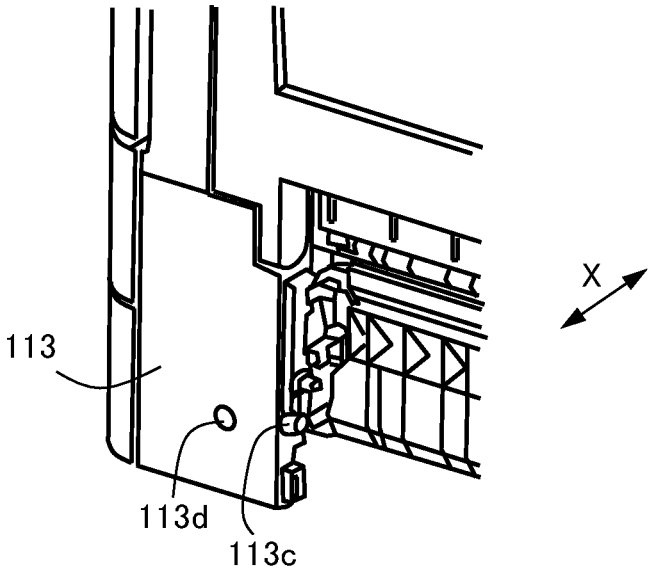
FIG. 13B is a perspective view of a right front cover illustrating the attachment and detachment of the cover of the sheet feed unit according to the second embodiment.

Next, the fixing of right front cover 113 to the apparatus body 10 is carried out by one screw not shown at a position of a fixing hole 113*d* illustrated in FIG. 13B. Since the right front cover 113 has a sufficiently small size, it does not have any means for positioning other than the fixing hole 113*d*, and the fixing performed by one screw is sufficient. A fixing direction is the arrow X direction, similar to the right rear cover 112. Further, a cylinder 113*c* that pivotally supports the pivoting door 12 is also arranged in the vicinity of the fixing hole 113*d*, similar to the right rear cover 112, and also on this end of the shaft, the positional dispersion of the pivoting door is considered.

According to the above description, the right rear cover 112 and the right front cover 113 can be fixed from the arrow X direction, and therefore, it can be attached and detached from the same direction. Therefore, the pivoting door 12 pivotally supported by both covers can also be removed simultaneously along with the attaching and detaching operation of both covers, such that the pivoting door 12 can also be easily attached and detached from the arrow X direction perpendicular to the exterior surface of the cover. The right depth-side cover 116 is not illustrated in FIG. 13, but it can similarly be attached and detached easily to and from the right rear cover 112 and the right front cover 113 via a snap-fit mechanism not shown, such that the attaching and detaching operations of various covers and units are not hindered.

Figure 14:
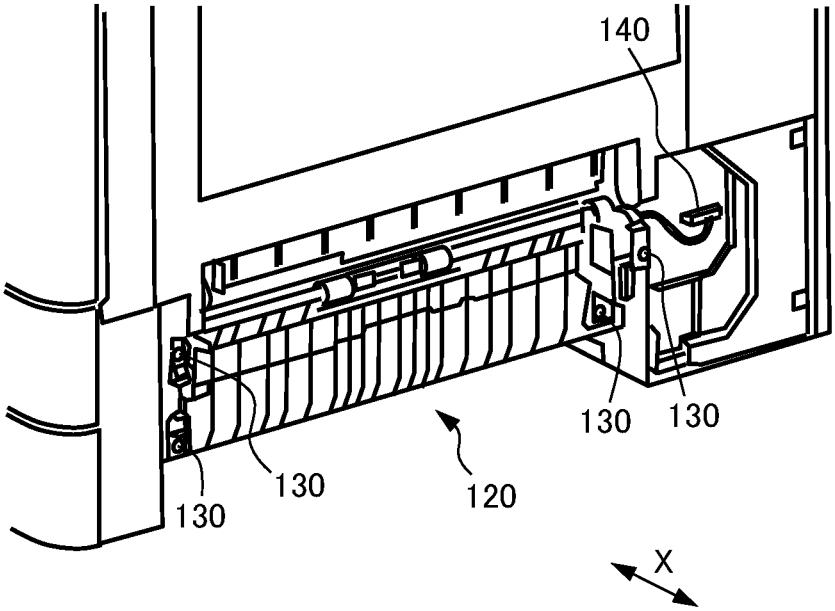
FIG. 14 is a perspective view illustrating the attachment and detachment of the sheet feed unit according to the second embodiment.

Next, the attachment and detachment of the sheet feed unit 120 will be described with reference to FIG. 14 illustrating a perspective view with the pivoting door 12, the right rear cover 112 and the right front cover 113 removed. In this state, a screw 130 for fixing the sheet feed unit 120 can be attached and detached, and the relay connector 140 for relaying the control signals to the sheet feed unit 120 can also be attached and detached. The relay connector 140 is arranged at a position hidden by the right rear cover 112, and this position is also the position in which a signal path from the main control board 201 arranged at a rear side of the apparatus is shortest. Therefore, by placing the relay connector 140 in this arrangement, the relay connector 140 can be accessed by the operation of removing the right rear cover 112, and simultaneously, the bundle wire length can also be shortened. According to the above description, the attachment and detachment of the screw 130 and the relay connector 140 is enabled from the arrow X direction, and therefore, it is recognized that the attachment and detachment of the pivoting door 12, the right rear cover 112, the right front cover 113, and the sheet feed unit 120 can all be performed from the same direction and with minimum action.

Figure 15:
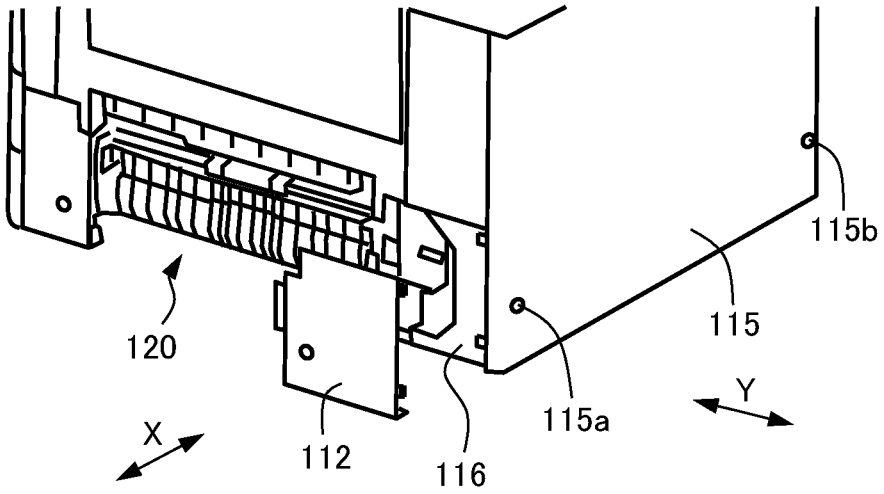
FIG. 15 is a perspective view illustrating a case in which a right depth-side cover and a right rear cover according to the second embodiment are integrated.

Now, a case in which the right depth-side cover 116 and the right rear cover 112 are integrated will be considered with reference to FIG. 15. The advantages of integrating the right depth-side cover 116 and the right rear cover 112 are that the number of components can be reduced and costs can be cut down, but as illustrated in FIG. 15, a rear cover 115 of the apparatus body is connected to the right depth-side cover 116 through a fixing hole 115*a*. In order to remove the right rear cover 112 that is integrated with the right depth-side cover 116, it is first necessary to access the apparatus from direction Y illustrated in FIG. 15, which is the rear side of the apparatus, such that the workability of replacement is deteriorated compared to the case where the components are not integrated and can be accessed from direction X. Further, it is clear that the right rear cover 112 and the right depth-side cover 116 being integrated has a greater size than the components that are not integrated, such that there is a need to use a plurality of screws for fixing. Therefore, from the above-mentioned viewpoints, it can be recognized that the present embodiment which enables the right rear cover 112 to be fixed by one screw only from direction X has superior workability of attachment/detachment and maintenance of the sheet feed unit 120.

As described above, according to the image forming apparatus 101 of the present embodiment, the workability of assembly, replacement and maintenance of electrical components that are not arranged on the rear side of the image forming apparatus 101 is also advantageous. Further, an arrangement of electrical components that do not cause the lengths of cables and bundle wires leading to the main control board 201 to be elongated undesirably is obtained.

According to the image forming apparatus 101 of the present embodiment, satisfactory workability of attachment/detachment and maintenance of the sheet feed unit 120 is realized.

According to the second embodiment described above, a roller separation system by the feed roller 26 and the reverse rotation roller 28 is adopted as the sheet feeding and separation system of the sheet feed unit 120, but the present technique can adopt various separation systems, such as an air sheet feed system or a claw separation system.

According to the present invention, the workability of assembly, replacement, and maintenance can be improved for the electrical components that are not arranged at the rear side of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-081509, filed May 13, 2021, which is hereby incorporated by reference herein in its entirety.

What is claimed is:

1. An image forming apparatus comprising:

a first electrical component;

a second electrical component;

a control board configured to control the first electrical component and the second electrical component;

a frame body supporting the first electrical component, the second electrical component, and the control board; and a connection unit configured to connect the first electrical component and the second electrical component to the control board, wherein the frame body includes a first frame and a second frame, the first frame being provided on a front side of the image forming apparatus and attached with the first electrical component and the second electrical component, the second frame being provided on a rear side of the image forming apparatus so as to be spaced from the first frame and attached with the control board, wherein the first electrical component includes a first connector configured to be connected to the control board, wherein the second electrical component includes a second connector configured to be connected to the control board, wherein the connection unit includes a first cable connected to the control board, a second cable connected to the control board, a first relay connector, and a second relay connector, the first relay connector being provided on a leading end portion of the first cable in such a manner that the first connector is connected to the first relay connector, the second relay connector being provided on a leading end portion of the second cable in such a manner that the second connector is connected to the second relay connector, and wherein the first relay connector and the second relay connector are located more frontward than the first frame.

2. The image forming apparatus according to claim 1, wherein the frame body includes a third frame that connects the first frame and the second frame, wherein the connection unit includes a case body that accommodates the first cable and the second cable, and wherein the case body is attached to the third frame.

3. The image forming apparatus according to claim 2, wherein the control board is arranged on the second frame such that at least a part of the control board is overlapped with the third frame when viewed in a direction along the third frame.

4. The image forming apparatus according to claim 1, wherein the first frame is a front side panel, and wherein the second frame is a rear side panel.

5. The image forming apparatus according to claim 1, further comprising a cover configured to open and close a first frame side of an apparatus body, wherein, in a state where the cover is in an opened state, the first connector, the first relay connector, the second connector, and the second relay connector are exposed.

6. The image forming apparatus according to claim 5, wherein the first electrical component is a switch configured to be switched by opening and closing of the cover.

7. The image forming apparatus according to claim 1, wherein the second electrical component is a fan configured to supply air to an interior of an apparatus body.

8. An image forming apparatus comprising:

a first electrical component;

a second electrical component;

a control board configured to control the first electrical component and the second electrical component;

a frame body supporting the first electrical component, the second electrical component, and the control board;

a connection unit configured to connect the first electrical component and the second electrical component to the control board; and a cover configured to open and close a first frame side of an apparatus body, wherein the frame body includes a first frame and a second frame, the first frame being provided on a front side of the image forming apparatus and attached with the first electrical component and the second electrical component, the second frame being provided on a rear side of the image forming apparatus so as to be spaced from the first frame and attached with the control board, wherein the first electrical component includes a first connector configured to be connected to the control board, wherein the second electrical component includes a second connector configured to be connected to the control board, and wherein the connection unit includes a first cable connected to the control board, a second cable connected to the control board, a first relay connector, and a second relay connector, the first relay connector being provided on a leading end portion of the first cable in such a manner that the first connector is connected to the first relay connector, the second relay connector being provided on a leading end portion of the second cable in such a manner that the second connector is connected to the second relay connector, wherein, in a state where the cover is in an opened state, the first connector, the first relay connector, the second connector, and the second relay connector are exposed.

9. The image forming apparatus according to claim 8, wherein the frame body includes a third frame that connects the first frame and the second frame, wherein the connection unit includes a case body that accommodates the first cable and the second cable, and wherein the case body is attached to the third frame.

10. The image forming apparatus according to claim 9, wherein the control board is arranged on the second frame such that at least a part of the control board is overlapped with the third frame when viewed in a direction along the third frame.

11. The image forming apparatus according to claim 8, wherein the first frame is a front side panel, and wherein the second frame is a rear side panel.

12. The image forming apparatus according to claim 8, wherein the first electrical component is a switch configured to be switched by opening and closing of the cover.

13. The image forming apparatus according to claim 8, wherein the second electrical component is a fan configured to supply air to an interior of an apparatus body.

* * * * *